US007540385B2

(12) United States Patent
Enenkel et al.

(10) Patent No.: US 7,540,385 B2
(45) Date of Patent: Jun. 2, 2009

(54) DEVICE FOR FILLING AND REMOVING CONTAINERS FOR SORTED MAIL

(75) Inventors: Peter Enenkel, Constance (DE); Armin Zimmermann, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 447 days.

(21) Appl. No.: 10/573,490

(22) PCT Filed: Sep. 16, 2004

(86) PCT No.: PCT/EP2004/010387

§ 371 (c)(1),
(2), (4) Date: Mar. 24, 2006

(87) PCT Pub. No.: WO2005/032732

PCT Pub. Date: Apr. 14, 2005

(65) Prior Publication Data

US 2007/0056885 A1 Mar. 15, 2007

(30) Foreign Application Priority Data

Sep. 24, 2003 (DE) ..... 103 44 507

(51) Int. Cl.
*B07C 5/00* (2006.01)
*B07C 7/00* (2006.01)

(52) U.S. Cl. ..... 209/630; 209/584

(58) Field of Classification Search ..... 209/584, 209/900, 702, 703, 707, 933; 211/151; 198/346.1, 198/346.2, 594, 588; 193/35 TE; 414/404, 414/332, 331.04, 268, 269, 799, 789.9
See application file for complete search history.

(56) References Cited

U.S. PATENT DOCUMENTS

| | | | | |
|---|---|---|---|---|
| 4,518,160 | A | 5/1985 | Lambrechts et al. | |
| 5,353,903 | A * | 10/1994 | Kechel et al. | 193/3 |
| 5,385,243 | A * | 1/1995 | Jackson et al. | 209/509 |
| 6,026,967 | A * | 2/2000 | Isaacs et al. | 209/539 |
| 6,397,999 | B1 * | 6/2002 | Taylor | 193/35 TE |
| 6,435,353 | B2 | 8/2002 | Ryan, Jr. et al. | |
| 7,012,211 | B2 * | 3/2006 | Brinkley et al. | 209/584 |
| 7,259,346 | B2 * | 8/2007 | Svyatsky et al. | 209/584 |
| 7,304,260 | B2 * | 12/2007 | Boller et al. | 209/584 |
| 2002/0070149 | A1 | 6/2002 | Schererz et al. | |
| 2003/0108416 | A1 * | 6/2003 | Schererz et al. | 414/794.4 |

FOREIGN PATENT DOCUMENTS

| | | |
|---|---|---|
| DE | 199 01 444 C1 | 2/2000 |
| DE | 199 61 513 C1 | 1/2001 |
| EP | 1 243 349 A1 | 9/2002 |

* cited by examiner

*Primary Examiner*—Patrick H Mackey
*Assistant Examiner*—Mark Hageman
(74) *Attorney, Agent, or Firm*—Young & Thompson

(57) ABSTRACT

A device for filling and removing containers (8, 9) for sorted mail. The containers are filled from two sorting points (2, 3) of a sorting device (1) that are arranged in two rows one above the other and can be transferred to a storage and transport device (10). A telescopic retaining mechanism (4) for holding two containers (8, 9) one behind the other is located beneath the two sorting points (2, 3) that are arranged one above the other, the mechanism being extended halfway to fill the front container (9) or completely to fill the rear container (8) or both containers (8, 9).

18 Claims, 5 Drawing Sheets

DEVICE FOR FILLING AND REMOVING CONTAINERS FOR SORTED MAIL

BACKGROUND OF THE INVENTION

1. Field of the Invention

Figure 1:
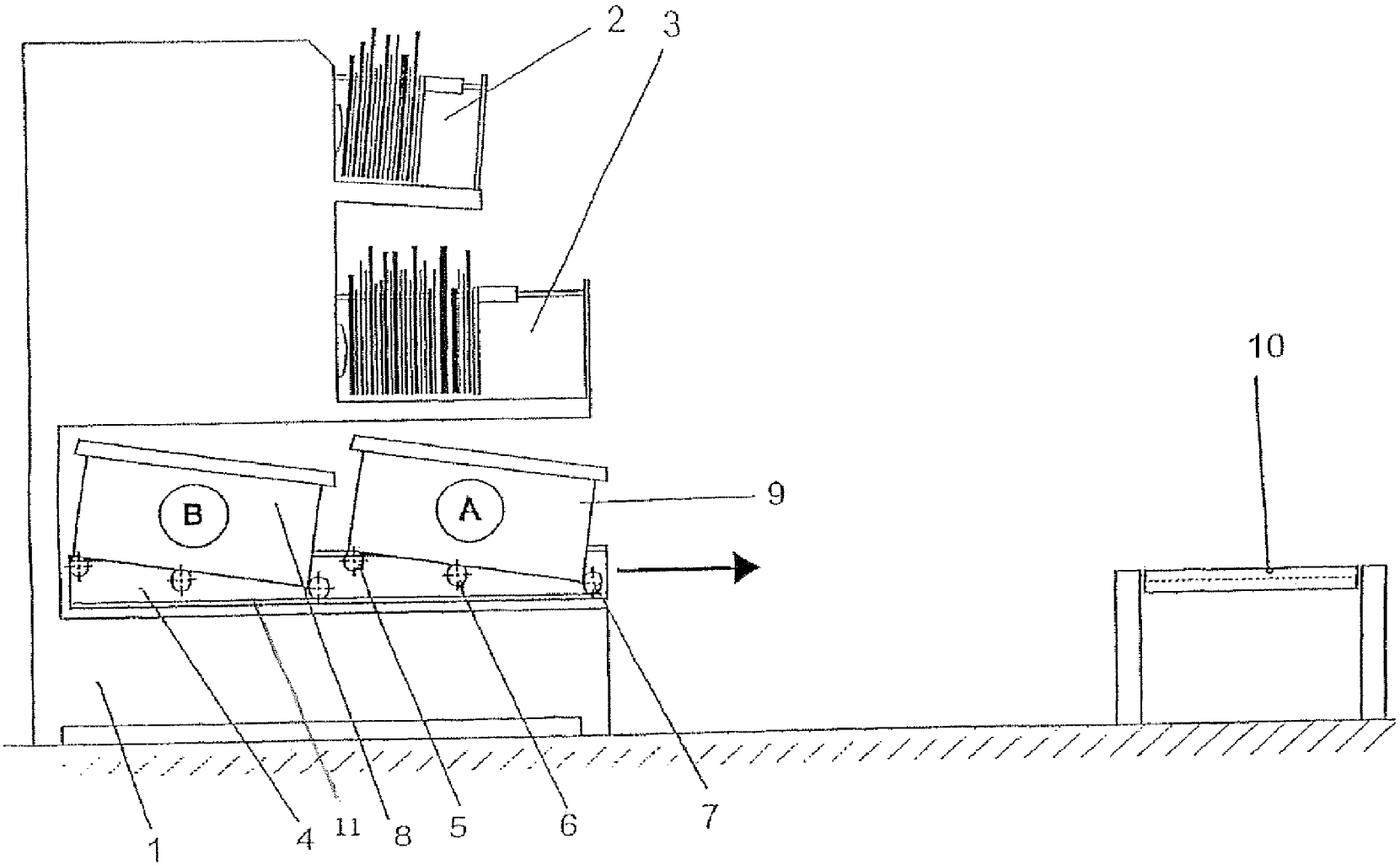

The invention relates to an apparatus for filling and removing containers for sorted mail.

2. Description of the Related Art

In sorting machines for flat mail, the mail items are sorted according to destination (address) into sorting compartments disposed along a sorting line and known as sorting endpoints. As soon as a sorting compartment is full of mail during the sorting process, it must be emptied, the mail items being manually removed from the sorting compartment and placed in a container which is located on a support. Each sorting compartment has such a container. For loading, the container is pulled out at right angles to the sorting line, the personnel standing side-on to the container in front of the preceding or following sorting endpoint. It may take several filling operations until a container is finally filled As soon as the container is completely full, it must be taken away (DE 199 61 513 C1)

This is often done manually. The filled container is lifted and placed, for example, on an opposite conveyor belt or on a shelf. This activity is physically demanding because of the weight of the filled container.

Devices have therefore been known which reduce the physical burden on personnel for filling and taking away the filled containers (EP 1 243 349 A1, DE 199 01 444 C1). However, these are only suitable for sorting machines with sorting endpoints in one row. If the sorting machine has two rows of sorting endpoints disposed one above the other, the known solutions cannot be used, as no container is available for the second sorting endpoint at the same point on the sorting line.

SUMMARY OF THE INVENTION

The object of the invention is therefore to create an apparatus which, in the case of a sorting machine with two rows of sorting endpoints disposed one above the other, allows the sorting endpoints to be emptied into containers and the latter to be temporarily stored or taken away with little physical effort.

Below two sorting endpoints disposed one above the other is an extendable support mechanism for accommodating two containers which can be extended half-way for filling the front container or completely for filling the rear container or both containers.

This provides the operator with two containers for filling in an ergonomic manner from both sorting endpoints disposed one above the other, without hindering the remaining sorting sequence.

Thus it is advantageous if the support mechanism in the completely extended state abuts, at approximately equal height, the storage and conveying device running as a conveyor line parallel to the sorting endpoints disposed in series.

This means that the containers can be effortlessly transferred to the conveying path.

It is also advantageous for the support mechanism to be implemented as a telescopically extending mechanism.

In order to implement the support mechanism with a view to moving the containers on the support mechanism with little effort, it is advantageous for the floor to be implemented flat and with minimal coefficient of friction.

In order to prevent unwanted moving of the containers in the support mechanism during extending of the support mechanism, said support mechanism advantageously has a frame with swiveling rollers on which the containers are supported and which can be moved toward the storage and conveying device or away from the storage and conveying device on the support mechanism. The rollers are disposed height-wise such that each container when at rest is inclined in the direction of a stop. It is particularly advantageous ergonomically if each container when at rest, held against the stop, is inclined in the direction of the storage and conveying device.

It is also advantageous for the last rollers in the inclining direction for each container at rest to be mounted in an elevated manner so that they act as a stop, so as to obviate the need for special stops.

The invention will now be explained in an exemplary embodiment with reference to the accompanying drawings in which:

BRIEF DESCRIPTION OF THE DRAWING FIGURES

Figure 2:
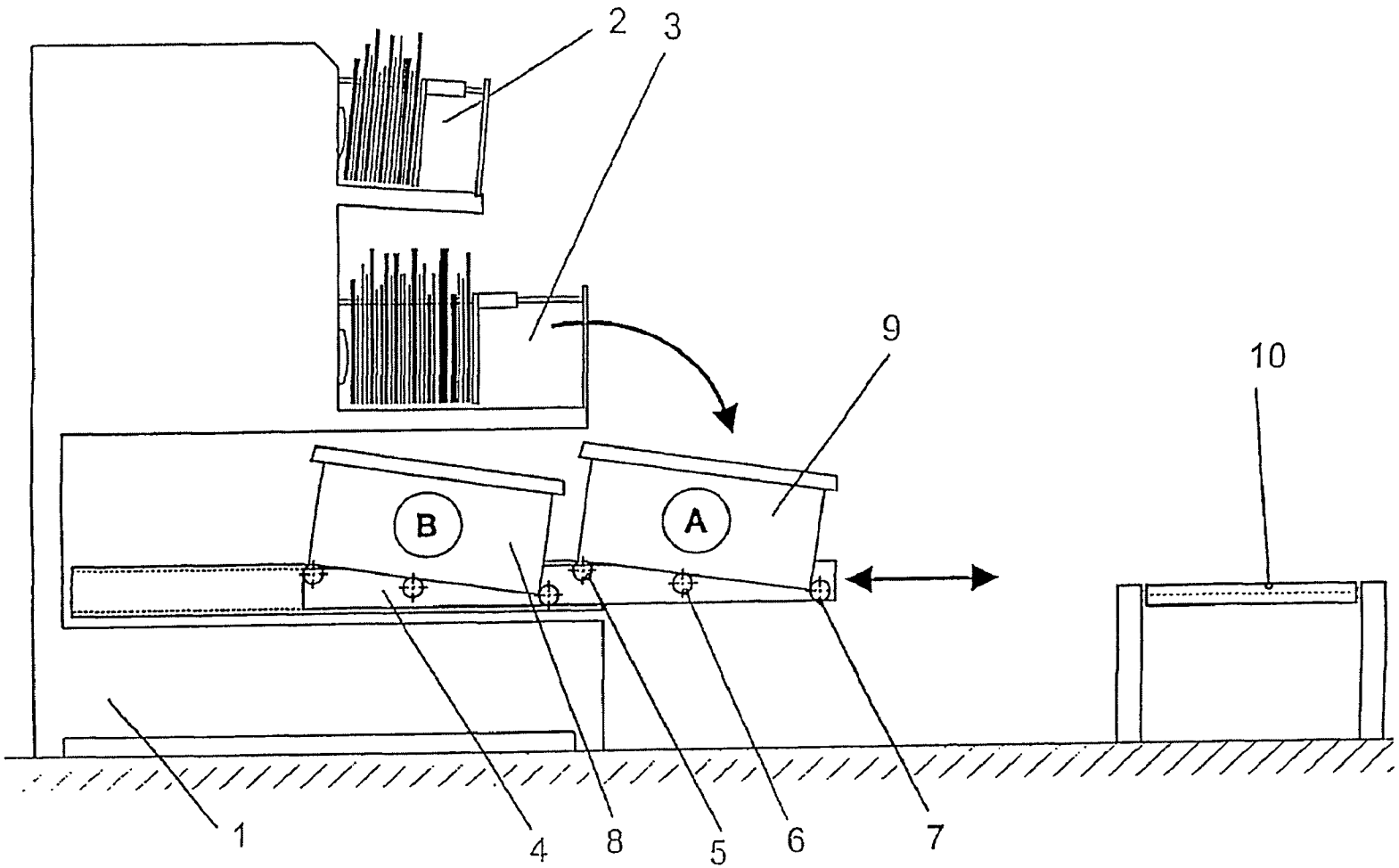
Figure 3:
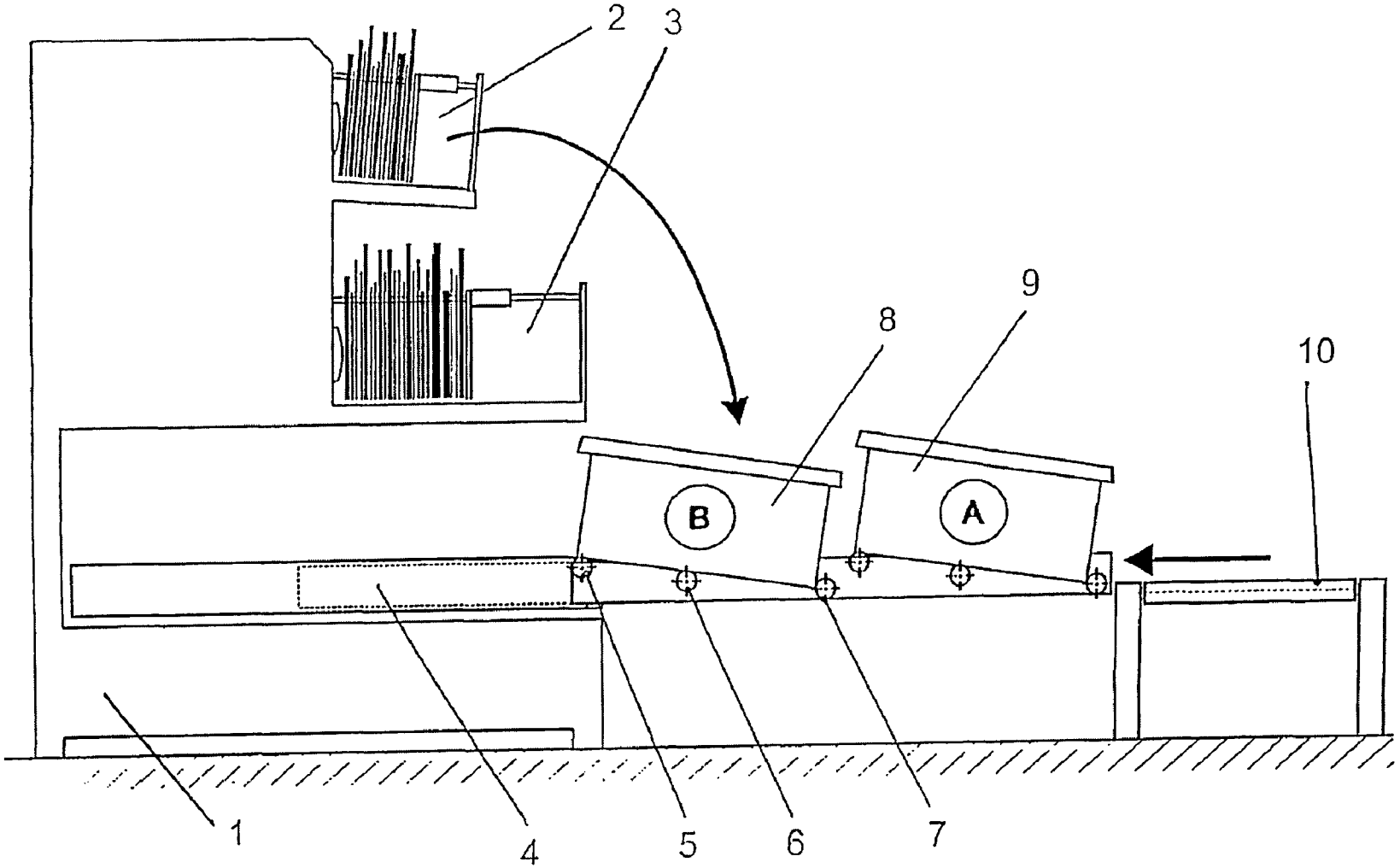
Figure 4:
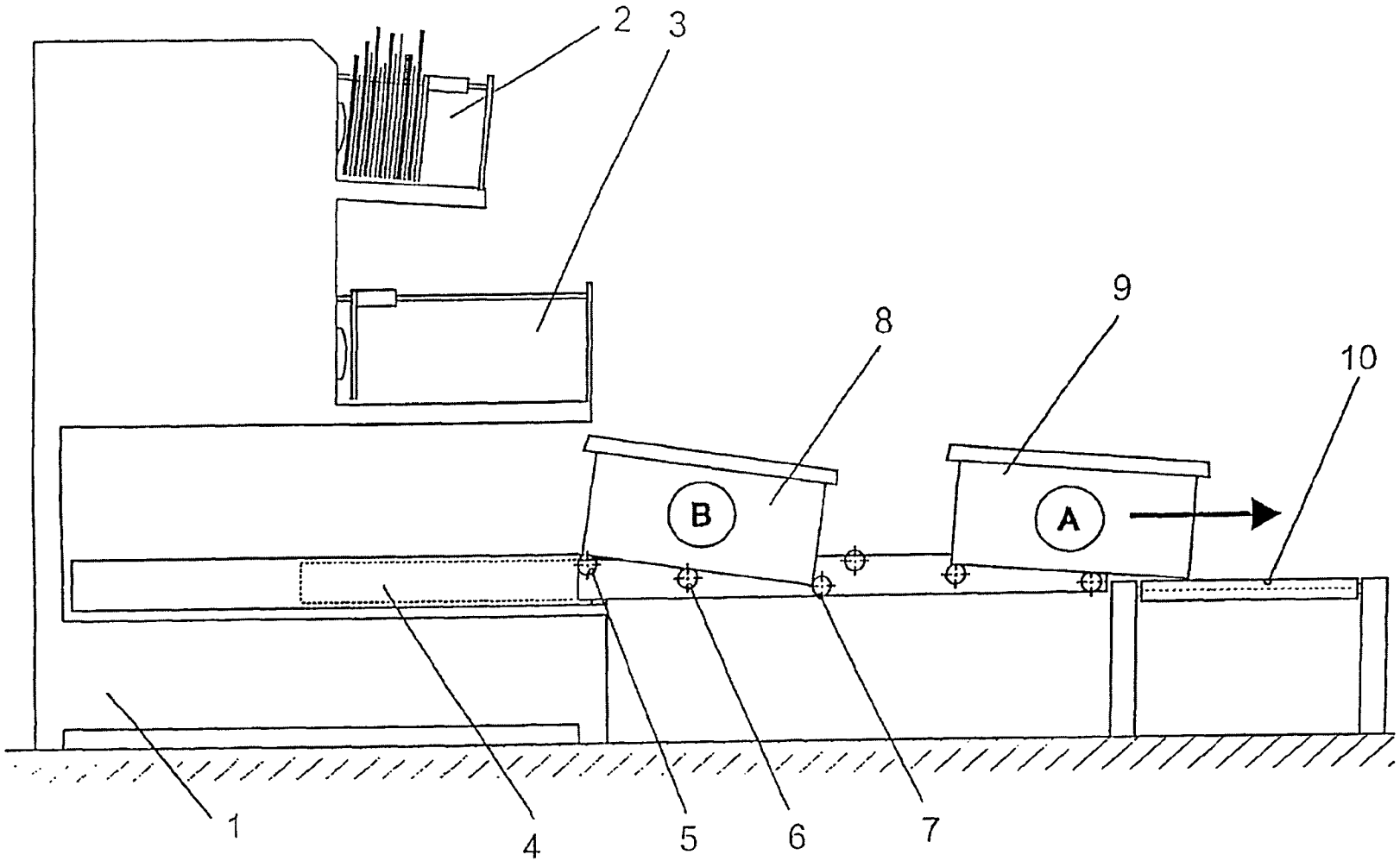
Figure 5:
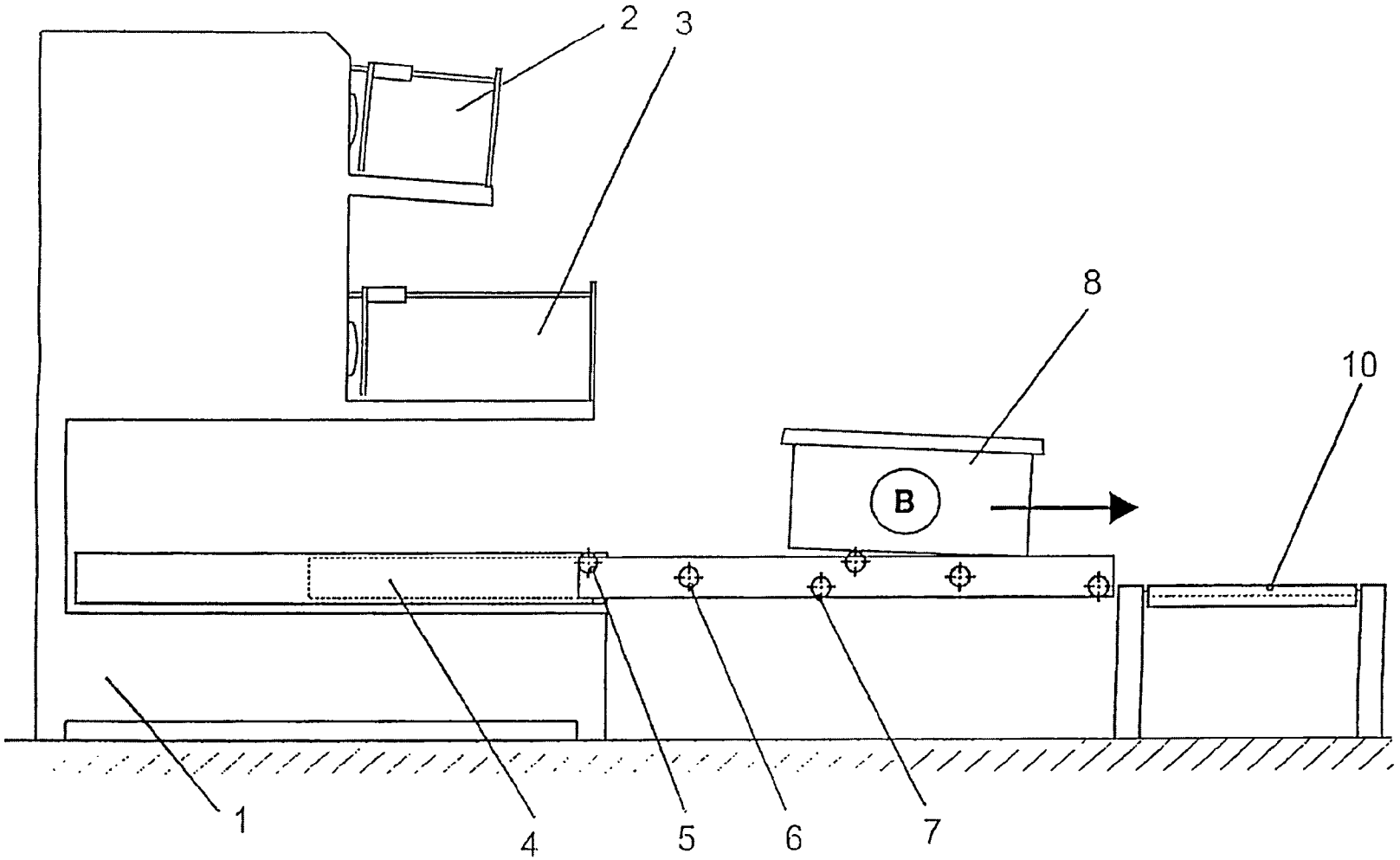

FIG. 1 shows a schematic sectional view of a sorting device with two rows of sorting compartments disposed one above the other and therebelow two containers at rest on a support mechanism, FIG. 2 shows a schematic sectional view according to FIG. 1 with half-way extended support mechanism for emptying the lower sorting compartment into the front container A, FIG. 3 shows a schematic sectional view according to FIG. 1 with fully extended support mechanism for emptying the upper sorting compartment into the rear container B, FIG. 4 shows a schematic sectional view according to FIG. 1 with fully extended support mechanism during transportation of the container A onto a roller conveyor track, FIG. 5 shows a schematic sectional view according to FIG. 1 with fully extended support mechanism for removal of the container B to the roller conveyor track.

DETAILED DESCRIPTION OF THE PREFERRED EMBODIMENT

As shown in FIG. 1, the sorting device 1 has two rows, disposed one above the other, of sorting compartments 2,3. For every two sorting compartments 2,3 disposed one above the other, the sorting device 1 has, below said sorting compartments 2,3, a support mechanism 4 on which are located two containers A,B 9,8 one behind the other for accommodating the mail items from the sorting compartments 2,3. The destination addresses to which mail items are statistically sent most frequently are assigned to the lower sorting compartments 3 for ergonomic reasons and the mail items for those destination addresses which do not receive mail items so frequently, i.e. the sorting compartments 2 not needing to be emptied so frequently by the operator, are sorted into the upper sorting compartments 2.

The support mechanism 4 is telescopically extendable as far as a roller conveyor track 10 as a storage and conveying device disposed parallel to the rows of sorting compartments, from where they are fed to other stations in the overall handling process.

If one of the sorting compartments 2,3 has reached a certain filling level, a signal is triggered by means of a filling level sensor and the operator empties the sorting compartment into a container A,B 9,8.

The support mechanism 4 has a flat floor 11 with a minimum coefficient of friction.

In order to minimize the manual effort both here and for transfer to the roller conveyor track 10, the mail items are loaded into the front container A 9 from the lower sorting compartment 3 (frequent change) and into the rear container B 8 from the upper sorting compartment 2. It can be seen that the containers 8,9 are supported on/against rollers 5,6,7 in such a way that they are inclined in the direction of the roller conveyor track 10 and strike the front most roller 7 in the direction of the roller conveyor track 10 in each case, these rollers 7 being disposed such that they absorb both a weight component and a force component directed toward the roller conveyor track 10. It is also possible for these rollers 7 to be disposed in such a way that they only support the container floor and for an additional stop to be mounted. By means of this roller arrangement, the containers are securely and stably positioned on the support mechanism even when it is in motion.

When the sorting compartment 3 has reached an appropriate filling level, it must be emptied. For this purpose the support mechanism 4 is extended out, as indicated by the arrow. As the mail items must be loaded into the container A 9, the support mechanism 4 is extended half-way, as shown in FIG. 2, so that the mail items can be comfortably stacked into the container A 9 by the operator. Due to the tilt of the containers 8,9, the mail items in the container also have a relatively stable position, resting against the narrow front sidewall of the container.

If it is full, the container A 9 is moved to the roller conveyor track 10 by extending the support mechanism 4 further or, if it is not yet full, it is pushed back under the sorting compartments 2,3, as indicated by the double-headed arrow.

As shown in FIG. 3, the upper sorting compartment 2 is so full that it has to be emptied into the container B 8. For this purpose the support mechanism 4 is extended fully and the container B 8 is loaded. As neither container 8,9 is full, they are pushed back under the sorting compartments 2,3 and temporarily stored.

If the lower sorting compartment 3 has been emptied into the container A 9 and the container A 9 is full, the container A 9 is lifted over the roller 7 and pulled onto the roller conveyor track 10 (FIG. 4).

As shown in FIG. 5, the container B 8, after being completely filled from the sorting compartment 2, is then likewise pulled from its rear position onto the roller conveyor track 10. If the container B has been completely filled before the front container A 9 is full, it must be lifted past the container A 9 onto the roller conveyor track 10. When the full container(s) A,B 9,8 have left the support mechanism 4, empty containers are placed on the support mechanism 4 which is then pushed back under the sorting compartments 2,3.

The invention claimed is:

1. A sorting device, comprising:

two rows of sorting compartments, the two rows being disposed one above the other;

an extendable support mechanism configured to accommodate two containers one behind the other, the support mechanism being disposed below the two rows of sorting compartments, the support mechanism being extendable halfway to fill a front container of the two container or completely to fill a rear container of the two containers or both containers;

means for sorting mail items into the sorting compartments according to their destination address; and a sorting and conveying device arranged such that the containers can be transferred from the support mechanism to the sorting and conveying device.

2. The sorting device according to claim 1, wherein the sorting and conveying device runs as a conveying track parallel to the two rows of sorting compartments.

3. The sorting device according to claim 1, wherein the support mechanism adjoin in its fully extended state at an approximately equal height as the storage and conveying device.

4. The sorting device according to claim 1, wherein the support mechanism has a telescopic extending mechanism.

5. The sorting device according to claim 1, wherein the support mechanism has a frame with swiveling rollers configured to support the containers, and the rollers are arranged such that the containers can be moved toward the storage and conveying device.

6. The sorting device according to claim 5, wherein the rollers are disposed height-wise for inclining each container to a stop when at rest.

7. The sorting device according to claim 6, wherein the rollers are disposed such that each container at rest, held against the stop, is inclined toward the storage and conveying device.

8. The sorting device according to claim 7, wherein the last rollers in the inclining direction are mounted in a raised manner so that they act as a stop.

9. The sorting device according to claim 1, wherein the support mechanism has a flat floor with a low coefficient of friction for accommodating and moving the containers on the support mechanism.

10. A sorting device, comprising:

two rows of sorting compartments, the two rows being disposed one above the other;

an extendable support mechanism configured to accommodate two containers one behind the other, the support mechanism being disposed below the two rows of sorting compartments, the support mechanism being extendable halfway to fill a front container of the two container or completely to fill a rear container of the two containers or both containers;

a device for sorting mail items into the sorting compartments according to their destination address; and a sorting and conveying device arranged such that the containers can be transferred from the support mechanism to the sorting and conveying device.

11. The sorting device according to claim 10, wherein the sorting and conveying device runs as a conveying track parallel to the two rows of sorting compartments.

12. The sorting device according to claim 10, wherein the support mechanism adjoin in its fully extended state at an approximately equal height as the storage and conveying device.

13. The sorting device according to claim 10, wherein the support mechanism has a telescopic extending mechanism.

14. The sorting device according to claim 10, wherein the support mechanism has a frame with swiveling rollers configured to support the containers, and the rollers are arranged such that the containers can he moved toward the storage and conveying device.

15. The sorting device according to claim 14, wherein the rollers are disposed height-wise for inclining each container to a stop when at rest.

16. The sorting device according to claim 15, wherein the rollers are disposed such that each container at rest, held against the stop, is inclined toward the storage and conveying device.

17. The sorting device according to claim 16, wherein the last rollers in the inclining direction are mounted in a raised manner so that they act as a stop.

18. The sorting device according to claim 10, wherein the support mechanism has a flat floor with a low coefficient of friction for accommodating and moving the containers on the support mechanism.

* * * * *